US005546702A

United States Patent [19]

deNormand et al.

[11] Patent Number: 5,546,702

[45] Date of Patent: Aug. 20, 1996

[54] ADJUSTABLE BRACE FOR WINDOW SASH

[75] Inventors: Richard S. deNormand, Rochester; Patrick E. Milligan, West Henrietta, both of N.Y.

[73] Assignee: Caldwell Manufacturing Company, Rochester, N.Y.

[21] Appl. No.: 425,483

[22] Filed: Apr. 20, 1995

[51] Int. Cl.[6] ..... E05D 15/22

[52] U.S. Cl. ..... 49/161; 49/419; 49/181

[58] Field of Search ..... 49/161, 176, 181, 49/414, 417, 419, 452, 453, 454

[56] References Cited

U.S. PATENT DOCUMENTS 3,464,157 9/1969 Rodriguez ..... 49/181 X
3,524,282 8/1970 Kraft et al. .
4,517,766 5/1985 Haltof .
4,726,148 2/1988 Tix ..... 49/414 X
4,941,285 7/1990 Westfall .
5,119,592 6/1992 Westfall et al. .
5,199,219 4/1993 Martini et al. .

*Primary Examiner*—Philip C. Kannan
*Attorney, Agent, or Firm*—Eugene Stephens & Associates

[57] ABSTRACT

A tilt window assembly is modified to include a pair of adjustable braces for controlling wind resistance. Each of the braces includes a bracing block and an adjustable stop. The bracing block fits within a shoe channel in a jamb liner and forms a fixed brace between the front face of the jamb liner and a side wall of the shoe channel. The adjustable stop extends from the bracing block through a back face of the liner and bears against the window frame. The adjustable stop together with the bracing block forms an adjustable length brace between the front face of the liner and the window frame.

31 Claims, 5 Drawing Sheets

ADJUSTABLE BRACE FOR WINDOW SASH

TECHNICAL FIELD

The invention relates to window assemblies with sashes moveable along sash runs within window frames and, in particular, to such assemblies with tilt sashes that are braced for wind resistance.

BACKGROUND

Window sashes are commonly mounted so they can be tilted inwardly to permit the outside glazing to be washed from inside the window frames. Wind force also urges the sashes inwardly. Accordingly, design objectives for tilting the sashes can be at odds with design objectives for wind resistance.

Double-hung window assemblies include upper and lower sashes that slide along sash runs between open and closed positions. The sash runs are often made from plastic jamb liners having front faces shaped for guiding the sashes, back faces resiliently supported from the window frames, and channels between the front and back faces providing clearance for sash counterbalance systems. The resilient supports, which include foam or spring backings, urge the front faces of the liners into contact with the sashes and provide a flexible seal between the sashes and the window frames.

Jamb liners for tiltable sashes include pairs of ridges for engaging plows formed in the sides of the sashes. Slots formed through the front faces of the liners separate outer and inner ridges of each pair for providing access to the counterbalance systems. Accordingly, each of the ridges is cantilevered from the front faces of the liners, and the liners are resiliently supported from the window frames. Although the ridges are sufficiently supported to guide the sashes under ordinary conditions, force can be used to tilt the sashes out of engagement with the ridges. The same direction of force can be applied by wind.

The wind force resistance problems of such tilt windows are difficult to solve because of the conflict between the need for easy tilting convenience and the need for strong wind resistance. The problem also becomes more severe as tilt windows are required to provide increasingly strong wind resistance so they can be certified to meet new standards.

Coassigned U.S. application Ser. No. 08/264,474, filed on Jun. 23, 1994, and which is hereby incorporated by reference, discloses use of braces for supporting outer ridges of the jamb liners adjacent to check rails of the lower sashes to improve wind resistance. The braces can be slid along the jamb liners away from the check rails so as to not interfere with sash tilting.

While suitable for many applications, care must be taken to return the braces to the check rail level to obtain the benefits of wind resistance. Also, the braces reinforce the jamb liners but do not limit compression of the jamb liners with respect to the window frames. Accordingly, improvements in wind resistance are limited.

SUMMARY OF INVENTION

Our new invention provides an optimum compromise between the need for tilting convenience and the need for wind resistance. For example, the force required to disengage tiltable sashes from their sash runs can be increased within the range of tilting convenience to a point providing adequate wind resistance. However, it would also be possible to temporarily favor either objective such as increasing wind resistance in advance of predicted winds.

One example of our invention is an adjustable bracing system for a tiltable sash including a jamb liner and a brace having two relatively moveable parts. The jamb liner includes the usual features of front and back faces, a channel between the faces, and a pair of outer and inner guide ridges for engaging a sash plow in the sash. The first part of the brace is located in the channel in a position supporting the outer guide ridge. The second part of the brace extends through an opening in the back face of the jamb liner for bearing against a window frame. The first and second parts of the brace are relatively adjustable for supporting the outer guide ridge of the jamb liner at different distances from the window frame to control a force required to disengage the sash from the jamb liner.

The first part of the brace is preferably an L-shaped block that includes a first bearing region for engaging the outer guide ridge and a second bearing region for engaging a side of the jamb liner within the channel. A detent projecting from the block engages an opening in the back face of the liner for positioning the block along the liner. The second part of the brace is preferably a set screw that is threadably mounted within a bore formed through the block. The bore is aligned with an opening in the front face of the liner between the guide ridges to permit access to the screw.

DRAWINGS

DETAILED DESCRIPTION

Figure 1:
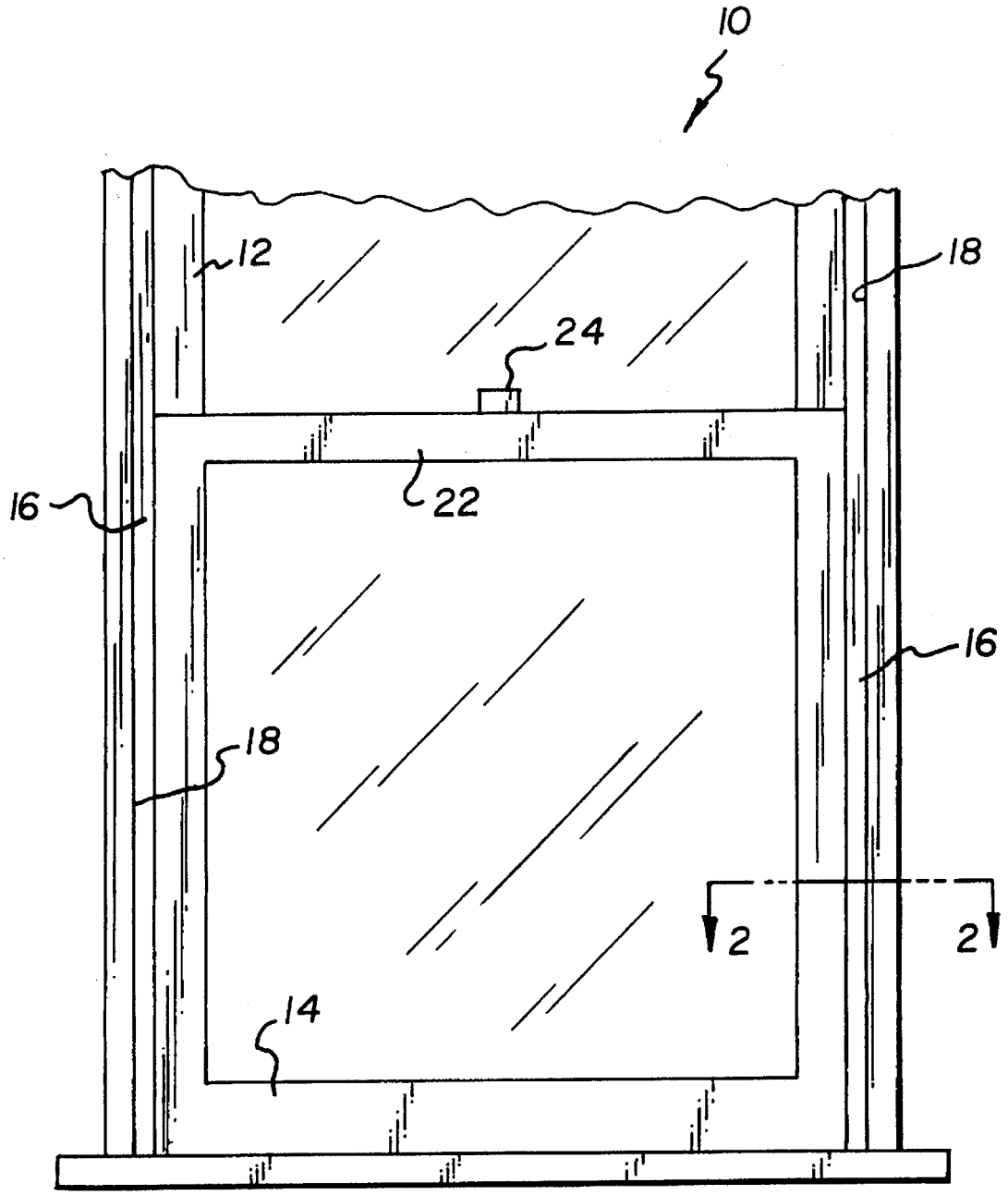
FIG. 1 is a fragmentary inside view of a double-hung window assembly having adjustable bracing elements according to the invention depicted in broken lines.

A double-hung window assembly 10 modified in accordance with our invention is shown in the drawing figures. The assembly 10 as depicted in FIG. 1 includes the usual features of upper and lower sashes 12 and 14 slidably mounted between a pair of jamb liners 16 within a window frame 18. The upper and lower sashes 12 and 14 can be tilted inwardly of the window frame 18 but are shown locked together at a check rail 22 of the lower sash 14 by a sweep lock 24.

Figure 2:
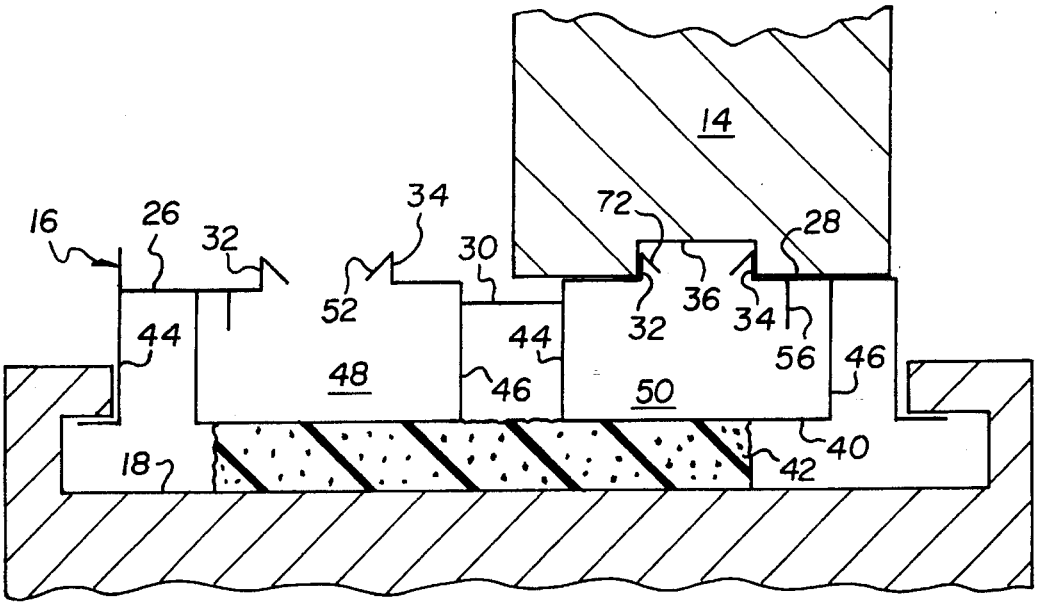
FIG. 2 is a cross-sectional end view of a jamb liner for guiding a sash of the window assembly within a window frame.
Figure 3:
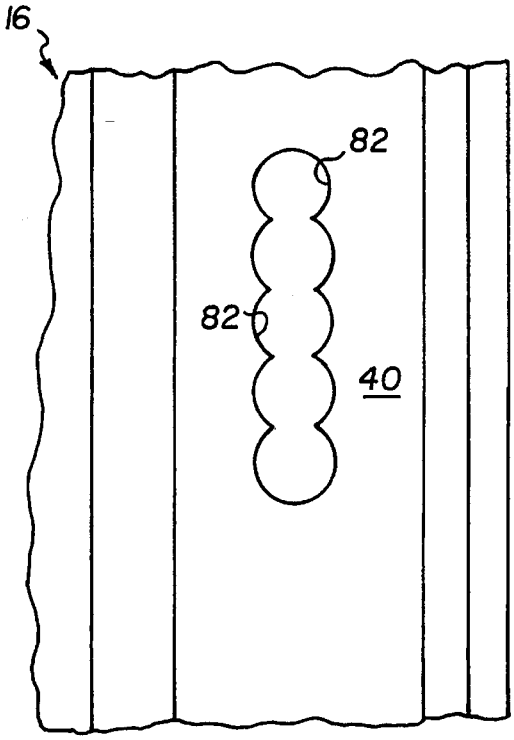
FIG. 3 is a fragmentary back view of the jamb liner.
Figure 4:
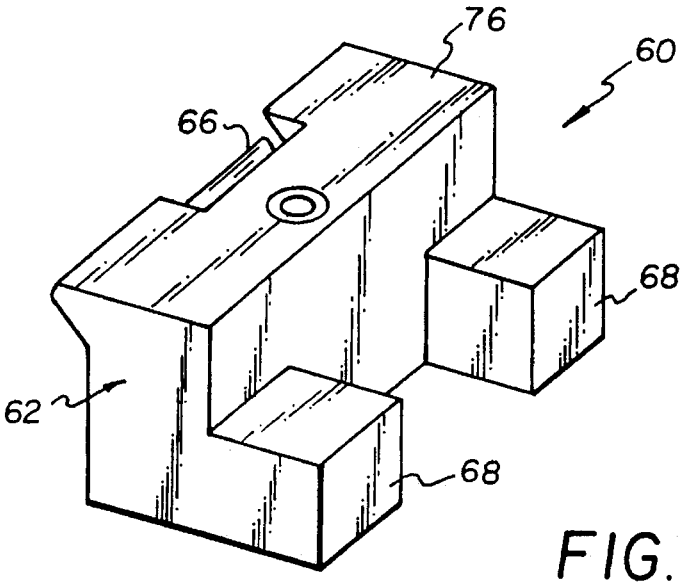
FIG. 4 is a perspective view of our new adjustable brace.

Referring to FIGS. 2 and 3, each of the jamb liners 16 has a pair of sash runs 26 and 28 formed in a front face 30. The sash runs 26 and 28 include respective pairs of outer and inner guide ridges 32 and 34 cantilevered from the front face 30 for engaging sash plows 36 of the upper and lower sashes 12 and 14. A back face 40 of the jamb liner is resiliently supported from the window frame 18 by a foam backing 42 that urges the sash runs 26 and 28 into sealing engagement with the sashes 12 and 14. Springs or other compressive elements can be used in place of the foam 42 to accomplish similar results.

The front and back faces 30 and 40 are separated by pairs of outer and inner walls 44 and 46 that form shoe channels 48 and 50 for a conventional counterbalance system (not shown). Slots 52 provide access to the counterbalance system between the outer and inner ridges 32 and 34. The shoe channels 48 and 50, which are hollow, together with the foam backing 42 allow the outer and inner ridges 32 and 34 to flex out of engagement with the sash plows 36 for tilting the sashes 12 and 14 with respect to the window frame 18.

The remaining drawing figures include various views of our new adjustable braces 60 for better controlling engagements between the outer ridges 32 and the sash plows 36. The adjustable braces 60, which are mounted in pairs near the level of the check rail 22, include an L-shaped bracing block 62 and an adjustable stop 64. The bracing block 62 is preferably molded from a resin material and has two key load bearing regions 66 and 68. The load bearing region 66 is slotted to engage a free end 72 of the outer ridge 32. The load bearing region 68, which is formed at the ends of two legs 74, abuts the inner wall 46 of the shoe channel 50. Thus, the bracing block 62 with its two load bearing regions 66 and 68 forms a brace between the outer ridge 32 and the inner wall 46 of the shoe channel 50.

The remaining portion of the shoe channel 50 provides clearance for a spring 58 or other component of the counterbalance. The L-shape form of the bracing block 62 allows the bracing block together with the adjustable stop 64 to be inserted into the channel 50 through the slot 52. A rib 56 extending from the front face 30 of the jamb liner holds the legs 74 of bracing block 62 in place within the shoe channel 50.

A top surface 76 of the bracing block 62 is inclined with respect to the front face 30 of the jamb liner to provide clearance for tilting the sash 14. A detent 78 is formed in a bottom surface 80 of the bracing block 62 to engage openings 82 (see FIG. 3) through the back face 40 of the jamb liner. The openings 82 are preferably positioned at or just above the level of the check rail 22 so the adjustable brace 60 is mounted near the check rail 22 but is accessible through the slot 52 in the front face 30 of the jamb liner. The openings 82 overlap in a series to accommodate different height sashes with the same jamb liners.

Figure 7:
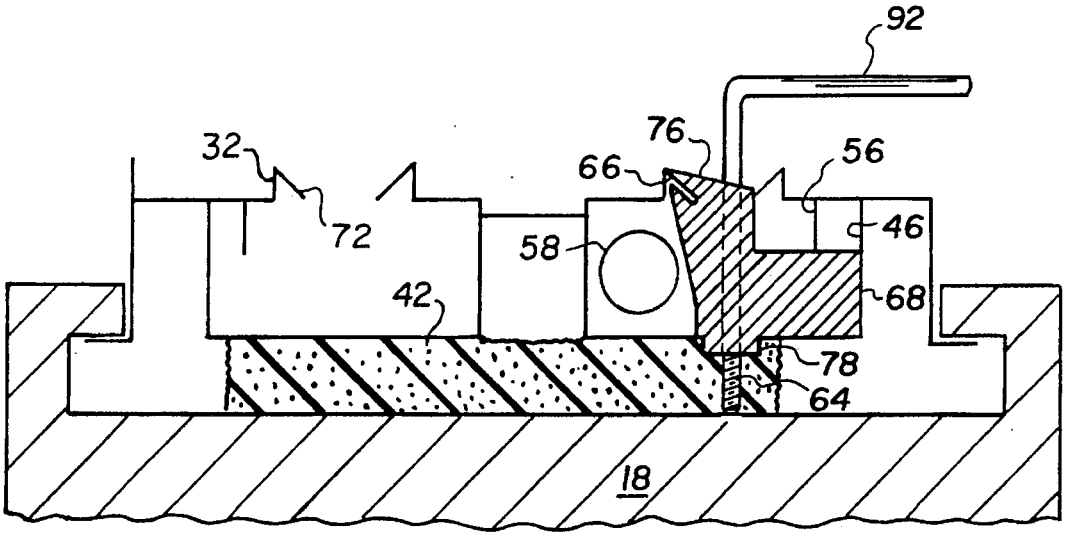
FIG. 7 is a cross-sectional end view of the jamb liner with the adjustable brace supporting a front face of the jamb liner from the window frame.
Figure 5:
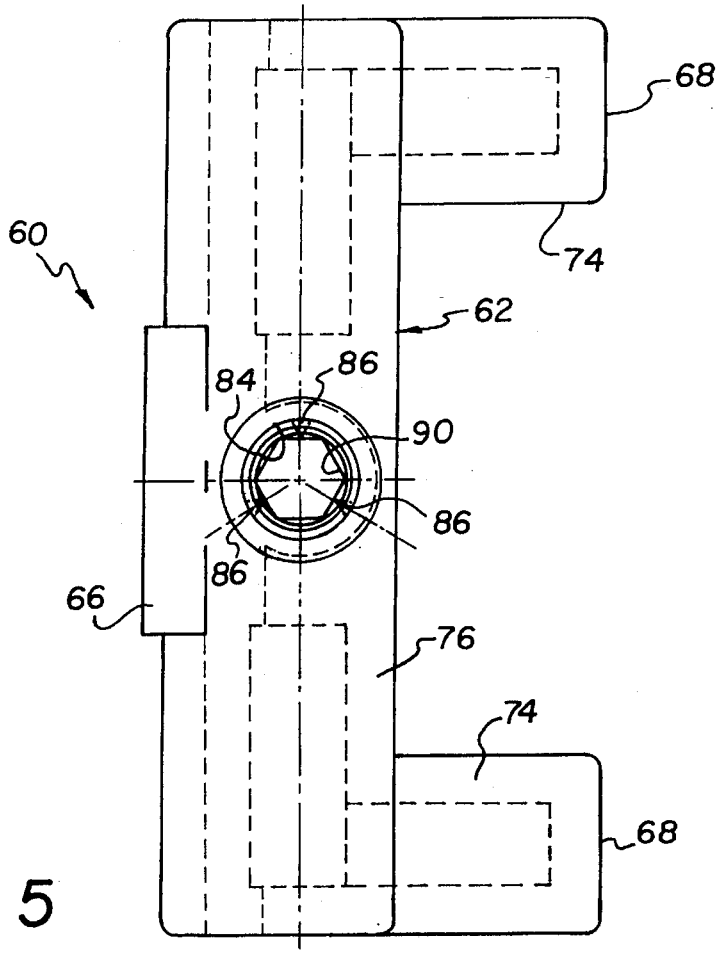
FIG. 5 is a top view of the adjustable brace.
Figure 6:
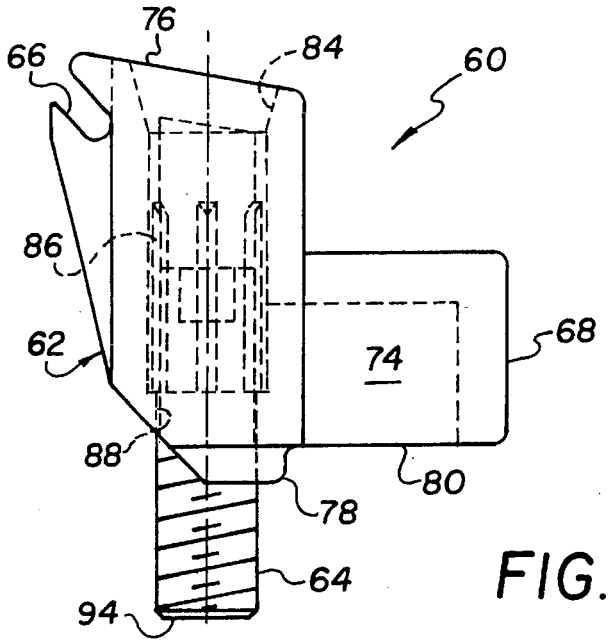
FIG. 6 is an end view of the adjustable brace.
Figure 8:
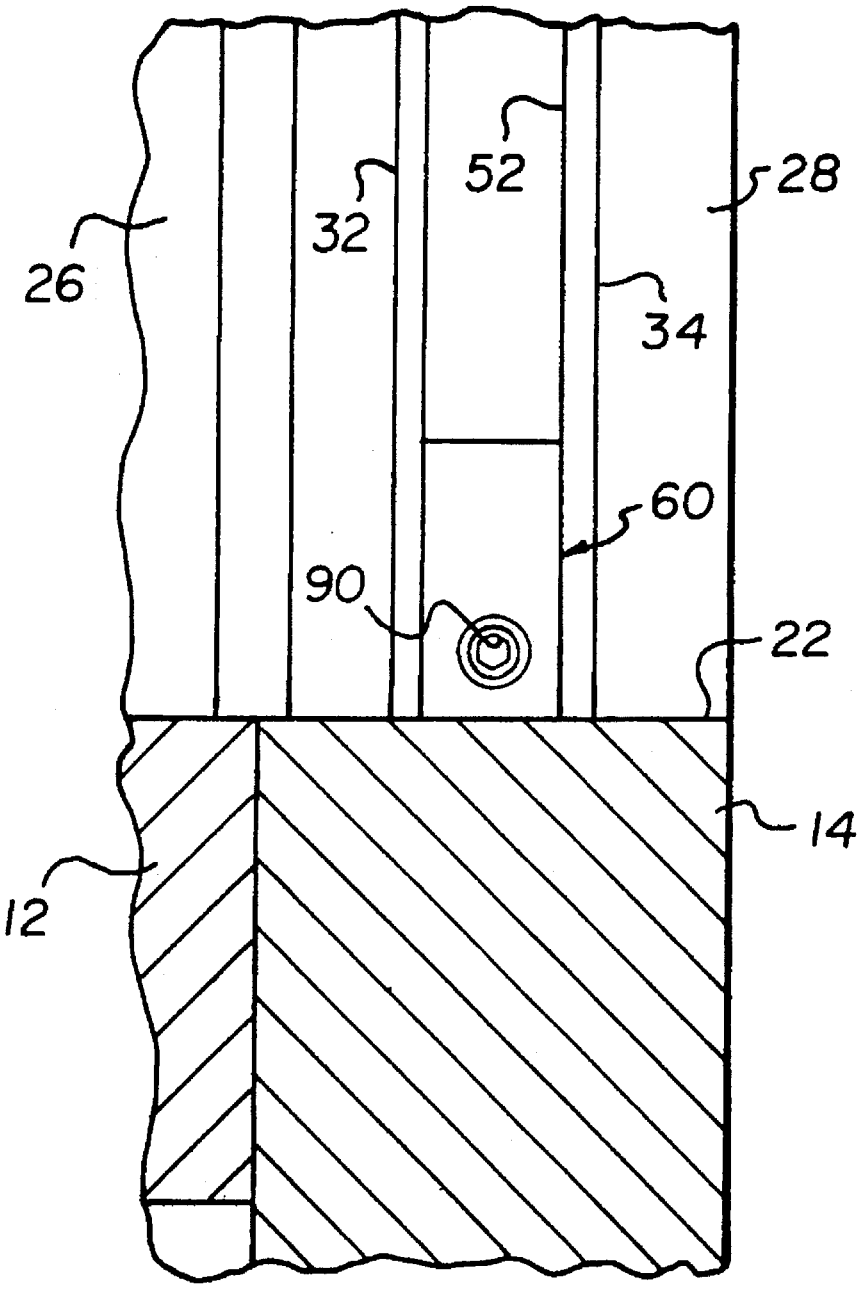
FIG. 8 is a fragmentary side view of the jamb liner showing access to the adjustable brace through the front face of the liner.

The adjustable stop 64 is preferably a set screw that is threadably engaged within a bore 84 formed through the bracing block 62. Three lands 86 in an upper part of the bore 84 provide an interference fit with the set screw 64 for self-tapping threads 88 in the lower part of the bore 84. A top end of the set screw 64 has a head 90 that is exposed in the bore 84, and the bracing block 62 is positioned for aligning the bore 84 with the slot 52 in the jamb liner 16 as best seen in FIG. 8. A wrench 92 (see FIG. 7), such as an Allen wrench, can be inserted through the slot 52 into the head 90 for turning the set screw 64. A bottom end 94 of the set screw extends through both one of the openings 82 in the back face 40 of the jamb liner and the foam backing 42 and bears against the window frame 18.

The bracing block 62 together with the set screw 64 forms an adjustable length brace for supporting the outer ridge 32 of the jamb liner at different distances from the window frame 18. Thus, the adjustable braces 60 limit flexibility of the outer ridges 32 and thereby control wind resistance. Preferably, the adjustable braces 60 are positioned in the jamb liners 16 at both ends of the check rail 22 for controlling pressure between the window sash 14 and the front faces 30 of the opposing jamb liners 16. Tightening the set screws 64 on opposite sides of the sash increases wind resistance, while loosening the set screws 64 makes tilting easier. The pressure between the sash 14 and the jamb liners 16 can also be adjusted to control frictional resistance to movement of the sash 14 along the jamb liners 16. Such resistance can be used to compensate for variations in the counterbalance force to prevent sash hop or sash drop.

The adjustable braces 60 can be adjusted to provide an optimum compromise between all of the factors affected by lengthening the braces, including wind resistance, ease of tilting, and frictional resistance to sash travel. However, it would also be possible to temporarily favor one of the factors such as loosening the braces 60 prior to tilting or tightening the braces prior to a wind storm.

Although the bracing block 62 preferably bears directly against the outer guide ridge 32 of the jamb liner and the adjustable stop 64 preferably bears directly against the window frame 18, similar effects could be achieved with intermediate elements that cooperate with the adjustable brace 60 to indirectly support the front face 30 of the jamb liner at adjustable distances from the window frame 16. Other adjustable stops could also be used including moveable elements that are adjustable in discrete steps and replaceable elements that function as shims. Other window assemblies having alternative forms of sash runs could also be modified to benefit from the invention.

We claim:

1. An adjustable window bracing system for a sash within a window frame comprising:

a jamb liner having front and back faces, a channel between said front and back faces, and a guide ridge on said front face for engaging a sash plow in the sash;

a brace having first and second relatively moveable parts; said first part of the brace being located in said channel in a position supporting said guide ridge;

said second part of the brace extending through an opening in said back face of the jamb liner for bearing against the window frame; and said first and second parts of the brace being relatively adjustable for supporting said guide ridge of the jamb liner at different distances from the window frame to control a force required to disengage the sash from the jamb liner.

2. The system of claim 1 in which said front face of the jamb liner includes outer and inner guide ridges for engaging opposite sides of the sash plow.

3. The system of claim 2 in which said first part of the brace engages said outer guide ridge for supporting said outer guide ridge at the different distances from the window frame.

4. The system of claim 3 in which said first part of the brace includes a slot for gripping a portion of said outer guide ridge.

5. The system of claim 3 in which said jamb liner includes outer and inner walls interconnecting said front and back faces, and said first part of the brace bears against said inner wall of the liner for further supporting said outer guide ridge.

6. The system of claim 5 in which said first part of the brace includes a detent for engaging said opening in the back face of the jamb liner.

7. The system of claim 6 in which said jamb liner includes a plurality of openings for engaging said detent in different positions along said channel.

8. The system of claim 3 in which said outer and inner guide ridges are separated by a space large enough to admit said brace through said front face of the jamb liner into position within said channel for supporting said outer guide ridge.

9. The system of claim 8 in which said first part of the brace is an L-shaped block.

10. The system of claim 9 in which said L-shaped block includes a top surface adjacent to said front face of the jamb liner, and said top surface is inclined with respect to the front face to permit the sash to be tilted into and out of engagement with said liner.

11. The system of claim 8 in which said channel is a shoe channel, and said L-shaped block provides clearance for a spring extending along said channel for counterbalancing the sash.

12. The system of claim 1 in which said second part of the brace is a set screw that is threadably mounted in said first part of the brace.

13. The system of claim 12 in which said set screw is received within a bore formed through said first part of the brace.

14. The system of claim 13 in which said bore through the first part of the brace is aligned with an opening in said front face of the liner to provide access to said set screw.

15. The system of claim 14 in which said front face of the jamb liner includes outer and inner ridges for engaging opposite sides of the sash plow, and said outer and inner ridges straddle said opening in the front face of the liner.

16. In a window assembly having a tiltable sash mounted between opposing sash runs in a window frame with guide ridges of the sash runs engaging sash plows of the tiltable sash and shoe channels between the guide ridges and the window frame providing clearance spaces for counterbalancing the tiltable sash, the improvement comprising:

a bracing block located in one of the shoe channels and bearing at least indirectly against one of the sash runs; and an adjustable stop projecting from said bracing block and bearing at least indirectly against the window frame for adjusting pressure between the one sash run and the tiltable sash.

17. The window assembly of claim 16 in which said bracing block is one of a pair of first and second bracing blocks located in the respective shoe channels, and at least one of said first and second bracing blocks includes said adjustable stop for adjusting pressure between both sash runs and the tiltable sash.

18. The window assembly of claim 17 in which said adjustable stop is one of a pair of first and second adjustable stops projecting from said first and second bracing blocks.

19. The window assembly of claim 16 in which said bracing block includes a top surface adjacent to the one sash run and a bottom surface adjacent to the window frame.

20. The window assembly of claim 19 in which said adjustable stop is adjustable through said top surface of the bracing block.

21. The window assembly of claim 20 in which said adjustable stop is a set screw that is threadably mounted in said bracing block.

22. The window assembly of claim 21 in which said set screw is received within a bore formed through said top surface of the bracing block.

23. The window assembly of claim 20 in which the tiltable sash is one of a pair of upper and lower sashes that are guided between respective pairs of the sash runs.

24. The window assembly of claim 23 in which said bracing block is located along the sash run of the lower sash in a position that permits adjustment of the adjustable stop through said top surface of the bracing block.

25. The window assembly of claim 24 in which said upper and lower sashes overlap along a check rail when closed.

26. The window assembly of claim 25 in which said bracing block is located along the sash run of the lower sash in a position just above the check rail.

27. The window assembly of claim 23 in which said top surface of the bracing block is inclined with respect to the lower sash run to permit the lower sash to tilt into and out of engagement with the lower sash run.

28. The window assembly of claim 16 in which said one shoe channel includes outer and inner walls connected to the one sash run, and said bracing block includes a first bearing region that bears against the one sash run and a second bearing region that bears against the inner wall of the shoe channel.

29. The window assembly of claim 28 in which said first bearing region engages one of the guide ridges of the sash runs.

30. The window assembly of claim 29 in which the one guide ridge is one of a pair of outer and inner guide ridges that engage one of the sash plows of the tiltable sash.

31. The window assembly of claim 30 in which said first bearing region engages the outer guide ridge.

* * * * *